United States Patent [19]

Lemmo

[11] 4,078,410

[45] Mar. 14, 1978

[54] PULLEY SPLITTING MACHINE

[75] Inventor: Anthony Lemmo, Euclid, Ohio

[73] Assignee: Eaton Corporation, Cleveland, Ohio

[21] Appl. No.: 679,260

[22] Filed: Apr. 22, 1976

[51] Int. Cl.[2] ..... B21D 22/16

[52] U.S. Cl. ..... 72/82; 29/159 R

[58] Field of Search ..... 72/80, 82, 83, 91; 29/159 R, 159.01; 90/11 A

[56] References Cited

U.S. PATENT DOCUMENTS

| | | | |
|---|---|---|---|
| 3,323,419 | 6/1967 | Riedel | 90/11 A X |
| 3,672,195 | 6/1972 | Pacak | 29/159 R X |
| 3,831,414 | 8/1974 | Haswell et al. | 29/159 R |

*Primary Examiner*—Leon Gilden

*Attorney, Agent, or Firm*—J. R. Teagno

[57] ABSTRACT

An apparatus for manufacturing split pulleys includes a frame and a spindle assembly supported by the frame and having an upper and lower spindle for supporting for rotation a blank to be split therebetween. The lower spindle includes a clamping mechanism having a screw means for drawing the upper spindle toward the lower spindle and the lower spindle toward the upper spindle to clamp the blank to be split therebetween. Bearing means are disposed between the frame and the spindle assembly for supporting the spindle assembly for rotation. The clamping means are operative to exert a clamping force between the upper and lower spindles which is isolated from the frame and the bearing means to clamp a blank therebetween. A pair of rotatable tools are provided each of which has an axis of rotation parallel to the axis of rotation of the spindle assembly and each of which is associated with a motor means to effect rotation of the tools. The tools are operable to move relative to the blank supported by the spindle assembly to effect sequential engagement between the tools and the peripheral edge of the blank to sequentially split and form the blank. Control means is provided for controlling the speed of the spindle to match the peripheral speed of the rotating blank supported by the spindle with the peripheral speed of the tool with which it is desired to engage the blank. The control means senses the speed of the first tool to be engaged with the rotating blank and controls the speed of the spindle in response to the speed of the first tool and subsequently senses the speed of the second tool to be engaged with the blank and controls the speed of the spindle in response to the speed of the second tool. The speed control of the peripheral speed of the tools and the rotating blank prevents skidding of the tools upon initial engagement of the blank with the tools.

17 Claims, 4 Drawing Figures

PULLEY SPLITTING MACHINE

BACKGROUND OF THE INVENTION

The present invention relates to an apparatus for manufacturing split pulleys and more particularly to an apparatus for manufacturing split pulleys wherein the bearings which support the main spindle assembly are isolated from the clamping forces established in the main spindle to clamp a blank to be split therein.

Apparatus for manufacturing pulleys is exemplified by the Haswell et al. U.S. Pat. No. 3,831,414 and the Pacak Pat. No. 3,087,531 which is specifically directed to apparatus for manufacturing split pulleys. In the known apparatus a clamping force is established between the frame and the spindle assembly to clamp a workpiece in the spindle assembly. The established clamping force exerts a substantial load on the main bearings which support the spindle assembly for rotation relative to the frame. The transfer of the clamping force to the main bearings which support the spindle assembly can cause premature failure of the bearings. Hence, it is desirable to substantially isolate the clamping force from the main spindle bearings to thereby extend the life of said bearings.

SUMMARY OF THE INVENTION

The present invention provides a new and improved apparatus for manufacturing split pulleys including a spindle assembly having an upper spindle, a lower spindle, means for rotatably supporting a blank to be split between the upper and lower spindles and a clamping mechanism for drawing the upper spindle toward the lower spindle and the lower spindle toward the upper spindle to clamp a blank to be split between the upper and lower spindles. A frame is provided for independently supporting the spindle assembly and bearing means is disposed between the frame and the spindle assembly to support the spindle assembly for rotation relative to the frame. The clamping mechanism is operable to exert a clamping force between the upper and lower spindles which is isolated from the frame and the bearing means. In this manner the life of the bearing means is substantially extended.

The present invention further provides an apparatus for manufacturing split pulleys including a workholder for rotatably supporting a blank to be split, a splitting tool supported for relative movement toward and away from a blank supported in the workholder to engage with the peripheral edge of the blank to effect splitting thereof, and a spindle assembly operably associated with the workholder to support the workholder for rotation. The spindle assembly includes a clamping mechanism for drawing one of the pieces of the workholder toward the other of the pieces of the workholder and drawing the other of the pieces of the workholder toward the one piece of the workholder to clamp a blank to be split in the workholder while enabling the clamping force established in one of the pieces of the workholder to be counteracted and balanced by the clamping force established in the other of the pieces of the workholder.

The present invention further provides a new and improved apparatus for manufacturing split pulleys as defined in the next preceding paragraph wherein the apparatus further includes a frame and bearing means for supporting the spindle for rotation in the frame. The bearing means supports the weight of the spindle assembly and is isolated from the clamping forces established on a blank by the clamping mechanism to thereby extend the life of the bearing means.

Another provision of the present invention is to provide an apparatus for manufacturing split pulleys including a frame, a spindle assembly for supporting a blank to be split and supported by the frame. The spindle assembly includes an upper spindle, a lower spindle and a clamping mechanism supported by the lower spindle. Main bearing means are provided between the frame and the lower spindle to support the lower spindle for rotation relative to the frame. A splitting tool is supported by the frame and movable toward and away from a blank supported by the spindle assembly to engage with the peripheral edge of the blank to effect splitting thereof. The clamping mechanism is engageable with the upper spindle to effect relative movement between the upper and lower spindles to clamp the workpiece therebetween and includes a screw means which is rotatable to effect relative movement of the upper and lower spindles. Selectively actuatable power means are provided for rotating the screw means relative to the lower spindle to effect relative movement of the upper and lower spindles toward one another to clamp a blank therebetween and for synchronously rotating the screw means and lower spindle to rotate a blank clamped between the upper and lower spindles.

DESCRIPTION OF THE PREFERRED EMBODIMENT

Figure 1:
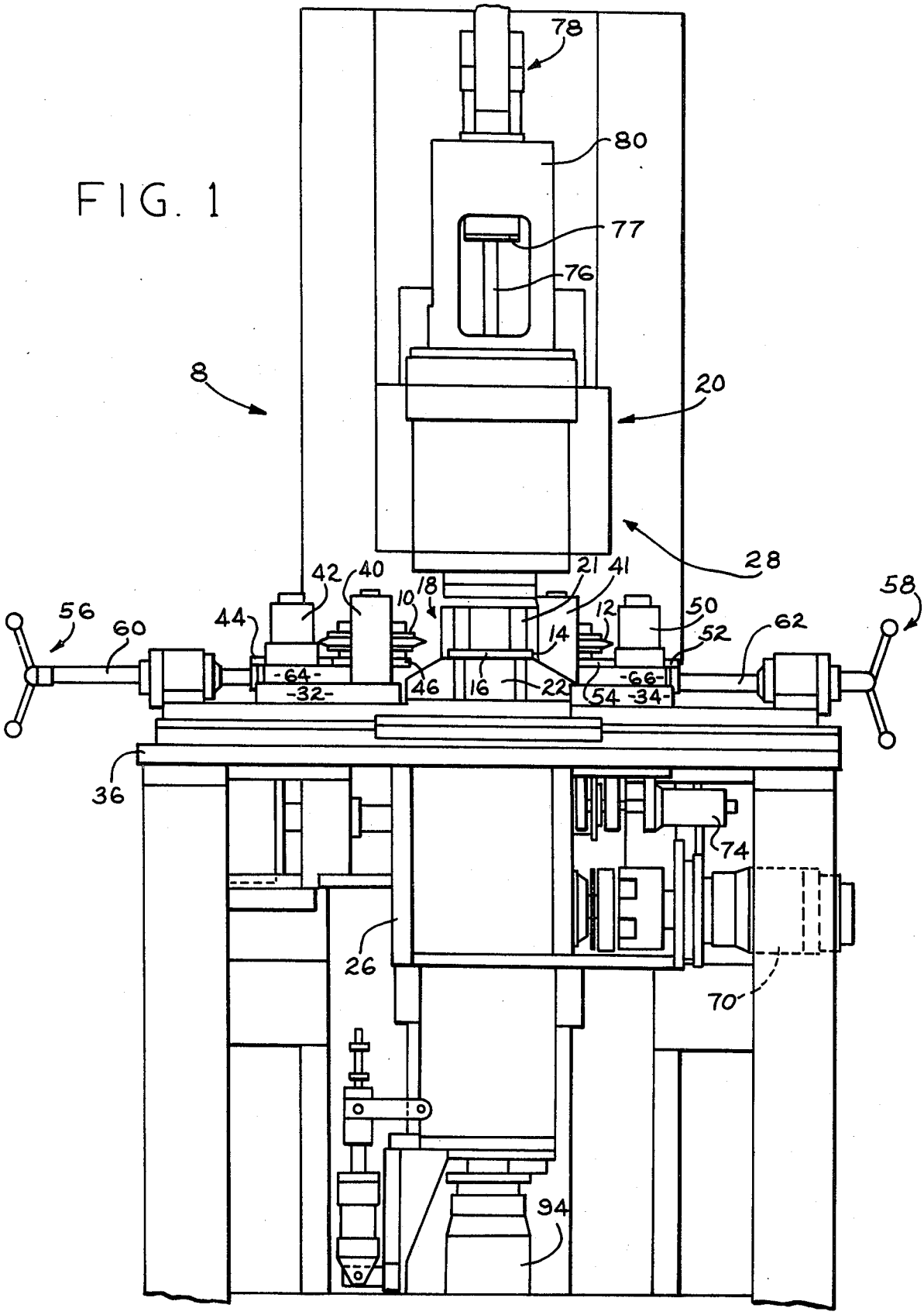
FIG. 1 is a front view of the apparatus for manufacturing split pulleys.
Figure 2:
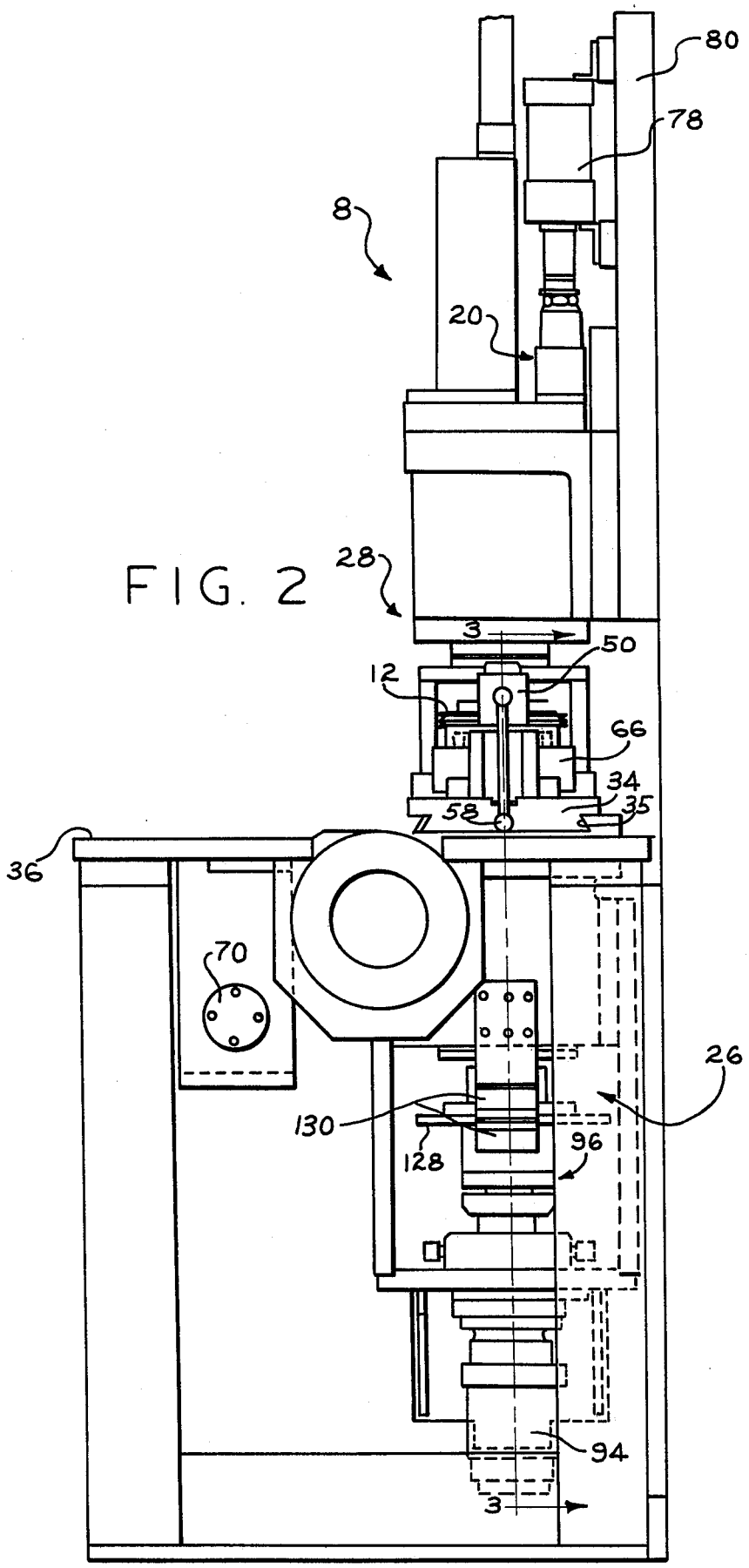
FIG. 2 is a side view of the apparatus illustrated in FIG. 1.

Referring to FIGS. 1 and 2 the present invention involves the use of a pulley splitting apparatus 8 which utilizes splitting and forming tool means for producing peripherally grooved wheels by engaging the tool means with the edge portion of a metal blank so as to split and form such edge portion into a grooved rim. The tool means comprise a splitting roller 10 and a forming roller 12 which are successively brought into operative engagement with the edge portion or periphery 14 of a disc shaped metal blank 16 for splitting such edge portion and shaping the same into a grooved rim, while the blank is being held and rotated by a workholder means 18.

A spindle assembly 28 is provided for supporting and rotating the blank 16. The spindle assembly 28 includes an upper spindle 20 and a lower spindle assembly 26 which respectively support an upper die 21 and a lower die 22 of the work-holder means 18. The upper and lower dies 21 and 22, respectively, can be clamped together by a clamping mechanism 30 which will be more fully described hereinbelow to rigidly support the metal blank 16 for rotation by the spindle assembly 28.

The splitting and forming tools 10, 12 are supported on the cross-slide members 32 and 34, respectively, for movement in an horizontal direction toward and away from a workpiece 16 supported by the spindle assembly 28. The cross-slide members 32 and 34 are supported on the table 36 of the machine 8. A guideway 35, more fully illustrated in FIG. 2, is disposed on the table 36 for guiding horizontal movement of the cross slide 34. A similar guideway, not illustrated, is disposed on the table 36 to guide the horizontal movement of the cross slide 32.

Affixed to the cross slide 32 for movement therewith is a support member 40 which supports the splitting tool 10 for rotation on the cross slide 32. Also, supported on cross slide 32 is a hydraulic motor 42 which is operable to effect rotation of the splitting tool 10 to prevent skidding of the tool 10 when it initially engages with the peripheral edge portion 14 of the blank 16 as will be more fully described hereinbelow. To this end the hydraulic motor 42 effects rotation of a planetary gear 44 which meshes with a planetary gear 46 supported by the support member 40. Planetary gear 46 is connected to rotate with the tool 10 by a shaft (not illustrated). Thus, energization of the hydraulic motor 42 effects rotation of the gears 44 and 46 which in turn effects rotation of the splitting tool 10.

Affixed to the cross slide 34 is the support member 41 which supports the forming tool 12 for rotation on the cross slide 34. A hydraulic motor 50 is similarly mounted on the cross slide 34. The hydraulic motor 50 effects rotation of a planetary gear 52 attached thereto which is engaged with a planetary gear 54. The planetary gear 54 is attached to the forming tool 12 by a suitable shaft, not illustrated, to effect rotation thereof. Thus, energization of the hydraulic motor 50 effects rotation of the gears 52 and 54 to thereby rotate the forming tool 12.

Manual adjustment means 56 and 58 are provided to effect vertical adjustment of the tools 10 and 12, respectively, with respect to the table 36 upon which the cross slides 32 and 34 are mounted. To this end the adjustment means 56 and 58 includes rotatable shafts 60 and 62, respectively, which are operable to be rotated to effect linear movement of carrier blocks 64 and 66 relative to the slide members 32 and 34, respectively. The carrier blocks 64 and 66 support the hydraulic motors 42 and 50 and the support means 40, 41 for the tools 10 and 12, respectively, on the cross slides 32 and 34. An inclined block arrangement, not illustrated, is utilized to effect vertical movement of the tools 10, 12, the support members 40, 41 and the hydraulic motors 42, 50 upon linear movement of the support blocks 64 and 66 relative to the cross slides 32, 34. The inclined block arrangement is a well known mechanism for transforming the linear motion imparted thereto by the adjustment means into vertical movement of the carrier blocks. To this end the inclined block arrangement includes complementary inclined planes which when moved horizontally relative to each other effect relative vertical movement of the parallel horizontal surfaces of the inclined planes. Thus, rotation of the shafts 60 and 62 will effect vertical movement of the tools 10, 12 relative to the workpiece 16 to thereby provide for a machine which is adapted to operate on various workpieces with various tools.

Hydraulic motor means are provided to effect movement of the cross slides 32 and 34 toward the axis of rotation of the spindle assembly 28 to effect sequential engagement of the tools 10 and 12 with the peripheral edge portion of the workpiece 16. To this end, a hydraulic motor 70 is mounted on the frame of the machine 8. The hydraulic motor 70 effects rotation of a pair of cam drums, not illustrated, which are connected to the cross slide members 32 and 34 in a well known manner. The drums which rotated in response to energization of the motor 70 include a plurality of cam tracks therein which are adapted to receive associated cams to control the horizontal movement of the cross slides across the table 36 and hence, the engagement of the tools 10 and 12 with the blank 16.

An encoder 74 is connected to the cam drum drive motor 70 to sense the point of operation of the machine 8 during any individual machine cycle. The encoder establishes an output signal indicative of the position in the machine cycle and which will be utilized as more fully described hereinafter.

In a preferred operation of the present apparatus the cam drums will be configured to enable the splitting tool 10 to first be moved into engagement with the peripheral edge portion 14 of the blank 16. After initial splitting is completed by the tool 10, the forming tool 12 will then move into contact with the blank 16. Penetration of the forming tool 12 will form the groove in the blank 16 established by the splitting tool 10. The forming tool 12 will operate to round the bottom of the groove and provide beads on the external edges of the groove if so desired. A further explanation as to the operation of the tools on the blank can be had with reference to the Pacak Pat. No. 3,087,531 entitled "Apparatus for Making Grooved Wheels".

Figure 3:
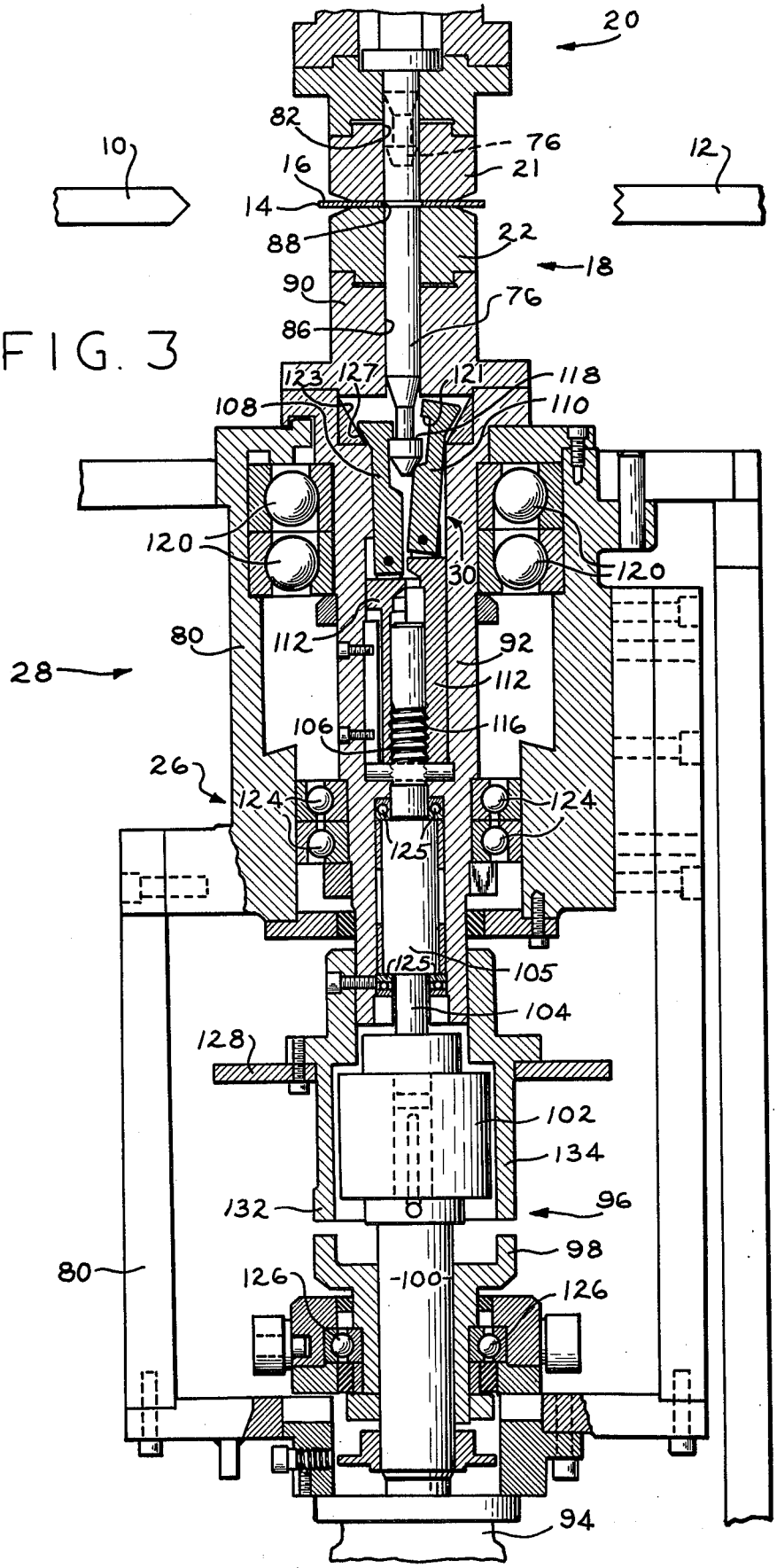
FIG. 3 is an enlarged cross-sectional view of the spindle assembly taken approximately along lines 3—3 of FIG. 2 more fully illustrating the clamping mechanism.

The spindle assembly 28 and the clamping mechanism 30 disposed in the lower spindle assembly 26 is more fully illustrated in FIG. 3. The upper spindle 20 supports the upper die 21 and is movable in a vertically upward direction from its position illustrated in FIG. 3 to enable a blank 16 to be positioned between the upper and lower dies 21, 22. To this end, an upper die cylinder 78 is mounted on the frame 80 of the machine, as is more fully illustrated in FIGS. 1 and 2, for effecting vertical movement of the upper spindle assembly 20.

A locating pin 76 is vertically slidable within a bore 82 disposed in the upper spindle 20 and in the bore 86 disposed in the lower spindle assembly 26 and which is coaxial with the bore 82. The locating pin 76 is operable to move from its retracted or uppermost vertical position illustrated in phantom lines in FIG. 3 to its extended or lowermost vertical position illustrated in full lines in FIG. 3. Each of the blanks 16 which is secured between the die members 21, 22 includes a centrally located opening 88 therein. When the locating pin 76 is in its extended position, it extends through the central opening 88 disposed in the blank 16 to located and center the blank 16 between the upper and lower dies 21, 22 prior to clamping of the blank therein. When the locating pin 76 is in its retractive position, as is illustrated in phantom lines in FIG. 3, a blank may be inserted or removed from between the die members 21, 22. A suitable fluid cylinder, not illustrated, can be utilized to raise and lower the locating pin 76.

The lower die member 22 is supported in a die adapter 90 which is supported on the lower spindle assembly 26 for rotation therewith. The lower spindle assembly 26 includes a substantially tubular lower spindle member 92 which may be rotated by a hydraulic motor 94 suitably connected thereto via a clutch 96. A shaft member 100, which is disposed coaxial to the axis of rotation of clutch 96, is connected through a torque tender 102 to the inner spindle shaft 104. The shaft 104 supports a torque screw 106 at one end thereof. Rotation of the shaft 100 by the motor 94 will effect rotation of the torque screw 106 via the torque tender 102 and the shaft 104 to thereby actuate the clamping mechanism 30 as will be more fully described hereinbelow.

The clutch 96 disposed between the fluid motor 94 and the lower spindle member 92 is selectively energizable to effect either rotation of the torque screw 106 relative to the lower spindle member 92 or synchronous rotation of the torque screw 106 and the lower spindle member 92. The clutch 96 includes a driving member 98 which is continuously connected to the output of the hydraulic motor 94 for rotation with the shaft member 100. When the clutch 96 is energized the driving member 98 of the clutch 96 engages with the teeth 132 of the driven member 134 of clutch 96 to effect rotation of the driven member 134 and the lower spindle member 92 which is connected thereto. A braking disc 128 is attached to the lower spindle member 92 to fix the lower spindle member 92 relative to the frame when the clutch 96 is deenergized and it is desired to rotate only the torque screw 106. A brake mechanism 130, schematicaly illustrated in FIG. 2, is provided for braking the disc 128 to thereby brake the lower spindle member 92.

The torque screw 106 is fixed vertically in the lower spindle assembly 26. Disposed contiguous to the threaded end of the torque screw 106 is a threaded finger holder 112 which is illustrated in FIG. 3 in two positions. The finger holder 112 is carried by the lower spindle member 92 for rotation therewith and is illustrated in its unclamped position on the right side of FIG. 3 and in its clamped position on the left side of FIG. 3 as will be more fully explained hereinafter. The finger holder 112 includes threaded portions 116 which engage with the threaded portion of the torque screw 106. Rotation of the torque screw 106 when the lower spindle member 92 is fixed from rotation will effect relative rotational movement between the finger holder 112 and the torque screw 106. The relative rotational movement of the finger holder 112 and the torque screw 106 will effect relative vertical movement of the finger holder 112, due to the engagement of the threaded portions 116 thereof with the threaded portion of the torque screw 106.

Pivotably attached to the finger holder 112 are the finger members 108 and 110. The finger members 108 and 110 are operable to rotate with the lower spindle member 92 and move vertically with the finger holder 112. The finger members 108 and 110 are adapted to pivot into engagement with the locating pin 76 to exert a downward clamping force on the locating pin 76 to clamp a blank between the upper and lower dies 21, 22 if the locating pin is in its downwardmost position as illustrated in full lines in FIG. 3. The locating pin 76 includes a shoulder portion 118 which is adapted to engage with the shoulder portions 121 disposed on the locating fingers 108 and 110. The lower spindle 92 includes the inclined surface 123 which engages with the complementary inclined surface 127 located on the exterior of the finger members 108, 110. Upon initial vertical movement of the finger members 108, 110 in a downwardly direction from the position of finger member 110 to the position of finger member 108, due to the movement of the finger holder 112 from its position shown on the right side of the locating pin 76 in FIG. 3 to its position shown on the left side of locating pin 76 the inclined surface 123 will engage with the inclined exterior surface 127 of the finger members to direct the finger member inwardly from the position of finger member 110 to the position of finger member 108 to effect engagement of the fingers with locating pin 76. After initial engagement of the finger members 108, 110 with the locating pin 76 further rotation of the torque screw 106 relative to the finger holder 112 will cause further downward movement of the fingers 108, 110. This further downward movement of the fingers 108, 110 will draw the locating pin 76 in a downwardly direction to thereby draw the upper die member 21 into engagement with the lower die member 22. It should be apparent that when the locating pin 76 is clamped in place by the finger members 108, 110 a positive clamping force will be established between the upper and lower die members 21, 22 to clamp a blank 16 therebetween. This clamping force will not be relieved or decrease until the torque screw 106 is rotated in an unclamping direction to effect disengagement of the finger members 108, 110 from the locating pin 76. A torque tender 102 is disposed between the hydraulic motor 94 and the torque screw 106 to limit the amount of torque and thus the clamping force exerted on the blank 16. The torque tender 102 operates in a well known manner.

The spindle assembly 28 is supported for rotation relative to the frame 80 by a pluraity of main bearings 120. The main bearings 120 are disposed between the lower spindle member 92 and the frame 80 of the machine 8. The bearings 120 support the upper spindle 20 and the lower spindle member 92 for rotation relative to the frame 80 of the machine. The bearings 120 support the weight of the spindle assembly 28 thereon and are also subjected to a radial load established by reaction forces generated upon engagement of the tools 10, 12 with the peripheral edge of the blank 16.

Bearing members 124 are disposed between the frame 80 and the lower portion of the lower spindle member 92. The bearings 124 center the lower portion of the lower spindle member 92 relative to the frame 80 while supporting the spindle 92 for rotation. As such, the bearings 124 do not support a major portion of the weight of the spindle assembly 28. A further set of bearing members 126 is provided to support the lower spindle assembly 26 for rotation. The bearing members 126 are disposed between the input member of the clutch 96 and the frame 80. The bearings 126 do not play a major role in supporting the spindle 26 but rather act to center the spindle for rotation relative to the frame 80. A plurality of bearings 125 engage with an enlarged portion 105 of the inner spindle shaft 104 to support the inner spindle shaft 104 for rotation relative to the lower spindle member 92. The bearings 125 engage with the end surfaces of the enlarged portion 105 of the inner spindle shaft 104 to transfer vertical reaction forces established during clamping of workpiece 16 from the torque screw 106 and the inner spindle shaft 104 to the lower spindle member 92.

After a blank 16 is initially located between the dies 21, 22 by a suitable loading mechanism, the blank will be clamped prior to rotation thereof. To effect clamping of a blank 16 between the dies 21, 22 the clutch 96 will be in its de-energized position illustrated in FIG. 3 and the brake 130 will be energized to engage the disc 128 and prevent rotation of the lower spindle member 92. The hydraulic motor 94 will then be energized to effect rotation of the inner spindle shaft 104 and the torque screw 106 relative to the fixed lower spindle member 92 and the finger holder 112 affixed thereto. Rotation of the torque screw 106 relative to the finger holder 112 will draw the fingers 108 and 110 in a downwardly direction to effect engagement thereof with the locating pin 76 to clamp a workpiece 16 between the upper and lower die members 21, 22. After the workpiece has been clamped and the brake 130 disengaged, the clutch 96 will be energized to effect engagement of the input member 98 with the teeth 132 of the output clutch member 134 to couple the spindle member 92 to the hydraulic motor 94 for rotation therewith. Thus, when the clutch 96 is energized the lower spindle member 92 and the torque screw 106 will rotate synchronously upon energization of the motor 94. Rotation of the spindle member 92 and the torque screw 106 will effect rotation of the whole spindle assembly 28 and the blank 16 clamped therein to enable the blank to be split upon engagement thereof with the splitting and forming tools 10, 12. Since the torque screw 106 is not rotating relative to the finger holder 112 synchronous rotation of the spindle member 92 and the torque screw 106 will not effect further clamping of a workpiece 16 by further drawing the fingers 108 and 110 in a downwardly direction.

It should be apparent that the location of the main spindle bearings 120 disposed between the outer spindle member 92 and the frame 80 enables the bearings 120 to support substantially the entire weight of the spindle assembly 28 while being substantially isolated from the clamping force established between the upper and lower dies 21 and 22 by the torque screw 106. Upon clamping, as discussed hereinabove, the torque screw 106 exerts a downward force on the locating pin 76 which includes a shoulder 118 thereon which exerts a force on the upper spindle 24 to pull the upper die 21 in a downwardly direction. The downward force exerted on the locating pin 76 also establishes an upward reactionary force on the fingers 108, 110 and the finger holder 112. The engaged threads on the torque screw 106 and the threads 116 on the finger holder 112 transfers the reactionary upward force from the finger holder to the torque screw 106 and from the torque screw 106 through the bearings 125 to the lower spindle member 92. The upward force exerted on the lower spindle member 92 is transferred through the die adapter 90 to the lower die 22 to thereby exert an equal and opposite clamping force on the blank 16 as exerted by the upper die 21. In this manner a clamping force is established between the upper and lower dies 21 and 22 which is approximately equal to 15,000 lbs. which clamping force is sufficient to secure the blank rigidly between the upper and lower dies 21 and 22 to prevent the blank from moving relative to the dies when the blank is slit and formed.

The main spindle bearings 120 are substantially isolated from the clamping force established between the upper and lower dies 21, 22 by operation of the clamping mechanism 30 due to the fact that the clamping mechanism 30 is wholly supported by the spindle assembly 28. This is a great advantage over known clamping arrangements for pulley splitting machines wherein the clamping force is exerted on the main spindle bearings due to the fact that the clamping force is developed between the spindle assembly and the frame of the machine. It can be seen by relieving 15,000 lbs. of force from the bearings 120 that their life will be substantially expanded. The weight of the spindle assembly 28 is between 700 and 800 lbs. depending on the dies for holding the workpiece. Thus, the bearings 120 are only subjected to a vertical force equal to the weight of the spindle which is approximately equal to 5% of the clamping force established by the torque screw. Thus, by isolating the clamping force from the bearings 120, the bearings are only subjected to 700–800 lbs. force in a vertical direction versus over 15,000 lbs. of force if the clamping forces were not isolated from the bearings.

The bearings 120 and the bearings 124 are also subjected to a radial force caused by engagement of the tools 10, 12 with the workpiece 16. To this end the splitting tool is operable to exert a 2,000 lbs. force in a radial direction on the blank 16 and the spindle assembly 28 when the splitting tool engages with the periphery 14 thereof. When the forming tool 12 engages with the periphery 14 of the workpiece 16 to form the groove, the forming tool 12 is operable to exert a radial force of up to 6,000 lbs. against the blank 16 and the spindle assembly 28. These radial forces are transferred in part to the bearings 120 and 124. The bearings 120 have the majority of the radial force applied thereto while the bearings 124 may support up to approximately 3,000 lbs. force in a radial direction. Thus, it can be seen that the bearing arrangement provides for isolation of the clamping force from the main spindle bearings 120 and the secondary spindle bearings 124. This, of course, will increase the life of the spindle bearings.

Figure 4:
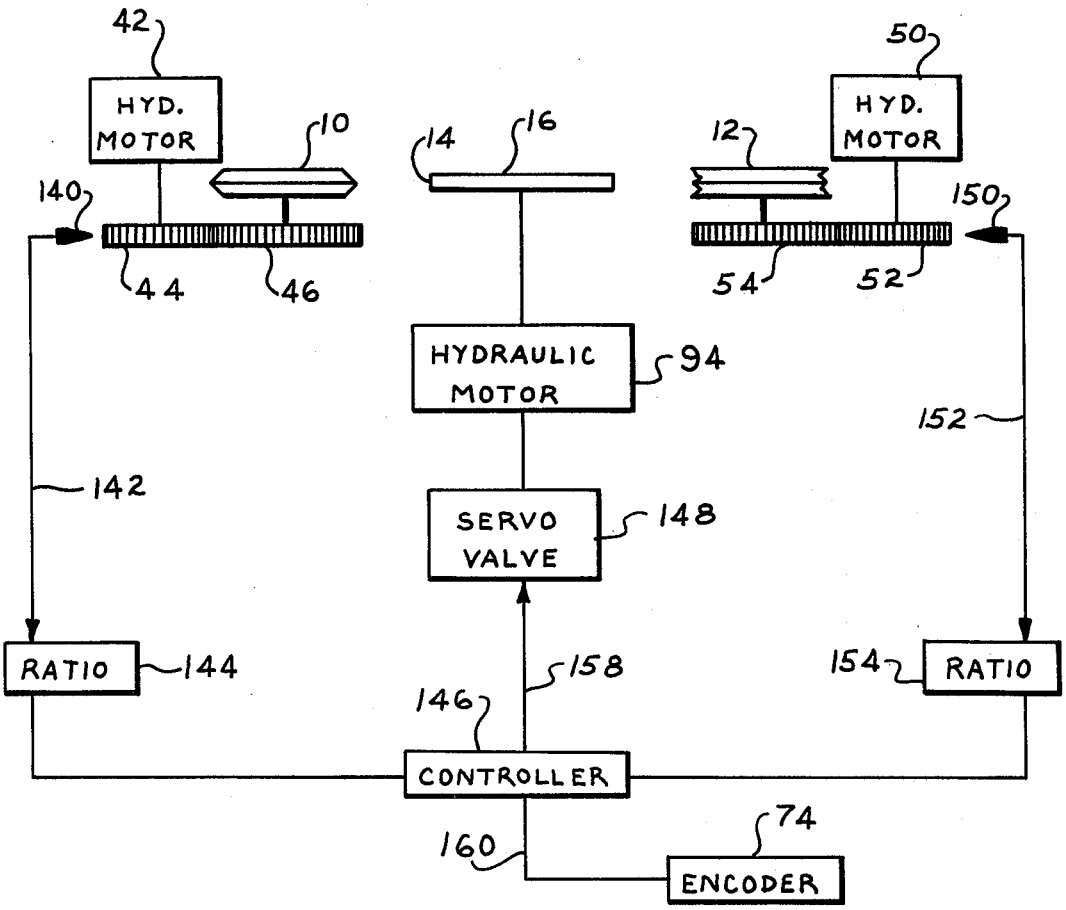
FIG. 4 is a schematic illustration of the control system for synchronizing the spindle and the rotating tools.

It is desirable to match the surface speed of the peripheral portion 14 of the blank 16 with the surface speed of the tools 10 and 12 upon initial engagement therebetween. Matching the surface speed of the tools 10, 12 with the surface speed of the peripheral edge 14 of the blank 16 will prevent skidding of the tools and premature wear thereof upon initial engagement of the tools with the blank 16. To this end, a control system, more fully illustrated in FIG. 4 is provided for matching the surface speed of the blank 16 with the surface speed of the tools 10, 12.

A sensor 140 is provided adjacent the gear 46 which drives the tool 10 in response to energization of the hydraulic motor 42 and rotation of the gear 44. The sensor 140 establishes a signal on line 142 which is indicative of the linear or surface velocity of the gear 46. The signal on line 142 is directed through a ratio control 144 to a master controller 146. The master controller 146 establishes a signal on line 158 which controls a servo valve 148 to thereby control the fluid flow to the hydraulic motor 94 and thus, control the rotational velocity of the spindle assembly 28 and the blank 16 supported therein.

The ratio control 144 is provided to scale the signal on line 142 before it is directed to the controller 146. The ratio control is programmed to take into account the relative diameter of the tool 10 and the blank 16 to scale the signal from sensor 140 to enable the controller 146 and servo valve 148 to match the surface speed of the blank 16 with the surface speed of the tool 10 for tools and blanks of various diameters. The signal on line 142, which is directed to the ratio control 144, is indicative of the surface velocity of gear 46 while the signal on line 142, as modified by the ratio control 144, is indicative of the surface velocity of the tool 10 when taking into account the relative diameters of the tool 10 and the blank 16. This enables the present machine to be used with various size tools and blanks wherein the surface velocities will vary over a wide range compared to the surface velocity of the gear 46 which is sensed by the sensor 140.

A sensor 150 is provided adjacent the gear 54 which drives the forming tool 12. The sensor 150 establishes a signal on line 152 indicative of the surface velocity of the gear 54 which rotates with the tool 12. A ratio controller 154 scales the signal on line 152 so that it is indicative of the surface speed of the forming tool 12 in a manner analogous to that discussed with respect to the ratio controller 154. The ratio control 154 then directs the signal which is now indicative of the surface speed of the forming tool 12 to the controller 146. The controller then establishes a signal on line 158 to bias the servo valve 148 to control the fluid flow to the hydraulic motor 94 to match the speed of the blank 16 rotated by the hydraulic motor 94 with the surface speed of the forming tool 12.

The encoder 74 provides a signal on line 160 which sets the controller 146 to either be responsive to the signal on line 142 indicative of the surface speed of the splitting tool 10 or responsive to the signal on line 152 indicative of the surface speed of the forming tool 12. The encoder 74 senses the position of the machine as it goes through each cycle and provides an instantaneous signal indicative of the position in the machine cycle on line 160 to the controller 146. As discussed hereinabove the splitting tool 10 initially engages the blank 16 to split the peripheral edge 14 thereof. After the tool 10 has penetrated the blank 16, then the tool 12 engages with the blank 16 to form the groove. Thus, it is desired to initially set the surface speed of the blank 16 equal to that of the tool 10 upon initial engagement therebetween and then set the surface speed of the blank 16 equal to the surface speed of the forming tool 12 when the tool 12 subsequently engages with the peripheral edge 14 of the blank 16.

The encoder 74 establishes a signal on line 160 indicative of the machine position. To this end when the tool 10 moves toward initial engagement of the blank 16, the controller 146 is actuated by a signal on line 160 from the encoder 74 to direct the signal on line 142 to the servo valve 148 to thereby set the surface speed of the blank 16 equal to the surface speed of the tool 10. After the tool 10 makes initial engagement with the blank at a synchronous surface speed the hydraulic motor 42 will be deenergized to allow the tool 10 to coast. The tool 10 will then be driven by its engagement with the blank 16. This is important due to the fact that the speed of the surface of the blank 16, which engages with the splitting tool 10, will vary as the tool 10 penetrates the peripheral edge 14 of the blank. The blank 16 will be maintained at a substantially constant angular velocity once set by the surface speed of the splitting tool 10 but the decrease in radius caused by the penetration of the tool 10 into the blank 16 will cause an increase in the surface speed of the engaged surfaces of the blank 16 and the tool 10.

After the tool 10 has made engagement with the blank 16 the forming tool 12 can then be moved into engagement with the blank 16. However, the surface speed of the blank 16 must then be matched to the surface speed of the tool 12 which is driven by the hydraulic motor 50. The encoder 74 will then operate to establish a signal on line 160 to set the controller 146 to be responsive to the signal on line 152 rather than the signal on line 142. In this manner the hydraulic servo valve 148 and hydraulic motor 94 will be energized to match the surface speed of the blank 16 with the surface speed of the forming tool 12 subsequent to matching the surface speed of the blank 16 with the surface speed of the tool 10. After the tool 12 has made initial engagement with the blank 16 the motor 50 will be deenergized to allow the rotating blank 16 to drive the tool 12. Thus, the control system will function to control the surface speed of the blank 16 to match the surface speed of the tools 10 and 12 as the tools sequentially engage with the blank 16.

The operation of the machine will now be briefly described. The machine 8 will start in a position in which the locating pin 76 is raised to its phantom line position illustrated in FIG. 3 and the tools 10 and 12 are spaced from the upper and lower dies 21 and 22. Initial operation of the machine will effect location of a blank 16 between the dies 21 and 22. The locating pin 76 will then be moved in a downwardly direction through the opening 88 disposed in the blank 16 to center the blank between the dies 21 and 22. The upper die cylinder 78 will then be energized to move the upper die 21 in a downwardly direction as the locating pin 78 moves in a downwardly direction. The locating pin 76 will then be in position to be engaged by the fingers 108 and 110. After the locating pin 76 is moved down the inner spindle member 104 and the torque screw 106 will be rotated by the hydraulic motor 94 while the lower spindle member 92 is fixed from rotation by energization of the spindle brake 130 to thereby clamp a blank 16 between the die members 21, 22.

After the torque screw 106 has affected clamping of the blank between the dies 21, 22 the spindle clutch 96 will be energized and the spindle brake 130 deenergized. The hydraulic motor 94 will then effect rotation of the spindle assembly 28 including the lower spindle member 92 and the torque screw 106. When the spindle 28 starts to rotate the motor 42 will be energized to rotate the splitting tool 10. The cam drum drive 70 will then be energized to move the cross slide 32 inwardly toward the axis of rotation of the spindle 28 to effect engagement of the splitting tool 10 with the blank 16. At this time the sensor 140 will direct a signal to the controller 146 which will then set the speed of the spindle 28 so that the surface speed of the blank 16 matches the surface speed of the tool 10. Upon initial engagement of the tool 10 with the blank 16 the motor 42 will be deenergized and the tool 10 will be allowed to coast and rotate in response to the rotational forces exerted thereon due to engagement with the blank 16. The tool 12 will then be moved toward the axis of rotation of the spindle 28 to effect engagement of the forming tool 12 with the blank 16. As the tool 12 is moved toward the blank 16 the tool will be rotated by energization of hydraulic motor 50. After hydraulic motor 42 for driving tool 10 is deenergized the encoder 74 will direct a signal to the controller 146 to set the controller to be responsive to the signal on line 152 indicative of the speed of tool 12 rather than the signal on line 142. Thus, as the tool 12 moves toward the blank 16 the sensor 150 will direct a control signal via line 152 to the controller 146 to thereby set the speed of the spindle 28 and the surface speed of the blank 16 to match the surface speed of the tool 12. Upon initial engagement of the tool 12 with the blank 16, the motor 50 will be deenergized to allow the tool 12 to coast in response to the rotational forces exerted thereon by the blank 16. It should be appreciated that the operation of the splitting tool 10 and the forming tool 12 can be either simultaneous on the blank 16 or sequential. However, the control system should be operable to control the speed of the blank to maintain the surface speed of the blank 16 equal to the surface speed of the tools 10, 12 upon initial engagement therebetween. After the tools 10 and 12 have performed their work on the blank 16, the carriages 32 and 34, respectively, will move to draw the tools away from the blank 16. At this time the spindle clutch 96 will be disengaged and the spindle brake 130 engaged. After the spindle brake is engaged the hydraulic motor 94 will be reversed to unscrew the torque screw 106 to unclamp the formed blank 16. After the torque screw 106 and the fingers 108 and 110 release the locating pin 76, the locating pin will be retracted in an upwardly direction and the upper die 21 will be raised to enable the formed blank 16 to be removed and a new blank inserted in the dies.

While the present machine has been described as having a vertical spindle assembly with upper and lower spindles, it should be apparent that horizontal operation of the present device is also contemplated. Moreover, the position of the upper and lower spindles could be reversed without effecting the operation of the present device and it is desired to cover such modifications herein.

From the foregoing, it should be apparent that a new and improved machine has been provided for manufacturing split pulleys and other grooved articles. The machine provides for a unique bearing arrangement wherein the main spindle bearings support the spindle for rotation but are isolated from the clamping forces established upon clamping the blank between the upper and lower spindles. Moreover, a unique control system has been provided for matching the surface speed of a blank supported in the spindle with the surface speed of a plurality of tools as the tools sequentially engage with the peripheral edge of the rotating blank.

I claim:

1. An apparatus for manufacturing split pulleys comprising a frame, a spindle assembly for rotatably supporting a blank to be split, said spindle assembly being supported by said frame and including an upper spindle, a lower spindle assembly, and a clamping mechanism supported by said lower spindle assembly, main bearing means disposed between said frame and said spindle assembly for supporting said spindle assembly for rotation relative to said frame, a splitting tool supported by said frame and movable toward and away from a blank supported by said spindle assembly to engage with the peripheral edge of the blank to effect splitting thereof, said clamping mechanism being rotatably supported by said lower spindle assembly concentric to the axis of rotation of said lower spindle assembly, said clamping mechanism being engagable with said upper spindle to effect relative movement of said upper spindle and said lower spindle assembly to clamp a work piece therebetween, said clamping mechanism including a screw means rotatable to effect said relative movement of said upper spindle and said lower spindle assembly, and selectively actuatable power means for rotating said screw means relative to said lower spindle assembly to effect relative movement of said upper spindle and said lower spindle assembly toward one another to clamp a blank therebetween and for synchronously rotating said screw means and lower spindle assembly to rotate a blank clamped between said upper spindle and said lower spindle assembly.

2. An apparatus for manufacturing split pulleys as defined in claim 1 wherein said upper spindle includes locating means attached thereto for centering blanks to be clamped and split, said locating means being adapted to be gripped by said clamping mechanism and moved relative to said lower spindle assembly to effect relative movement of said upper spindle and said lower spindle assembly and clamping of a blank therebetween.

3. An apparatus for manufacturing split pulleys as defined claim 2 wherein said clamping mechanism includes finger means for engaging with said locating means and effecting movement of said locating means and upper spindle relative to said lower spindle assembly to effect clamping of a blank between said upper spindle and said lower spindle assembly.

4. An apparatus for manufacturing split pulleys as defined in claim 1 wherein said main bearing means is operable to support the weight of said spindle assembly, said main bearing means also being adapted to receive a radial load thereon as a result of the radial forces applied to a clamped work piece upon engagement of the splitting tool therewith, said clamping mechanism being solely supported by said spindle assembly to isolate said main bearing means from the clamping forces established by said clamping mechanism on a clamped blank and said spindle assembly.

5. An apparatus for manufacturing split pulleys as defined in claim 2 wherein said screw means includes a first threaded member fixed axially relative to said lower spindle assembly, a cooperating second threaded member movable axially relative to said first threaded member upon relative rotation therebetween, said second threaded member being operable to move toward and away from said upper spindle upon rotation of said first threaded member, and finger means operatively associated with said second threaded member for engaging with said locating means and drawing said locating means and upper spindle toward said lower spindle assembly upon rotation of said first threaded member and movement of said second threaded member and finger means in response thereto.

6. An apparatus for manufacturing split pulleys as defined in claim 5 further including second bearing means disposed between said first threaded member and said lower spindle assembly for transferring axial clamping forces between said first threaded member and said lower spindle assembly to enable equal and opposite forces to be established on said upper spindle and said lower spindle assembly upon clamping of a blank therebetween.

7. An apparatus for manufacturing split pulleys comprising a spindle assembly including an upper spindle, a lower spindle assembly, means for rotatably supporting a blank to be split between said upper spindle and said lower spindle assembly, and a clamping mechanism, said clamping mechanism including gripping means operatively connected to one of said upper and lower spindle assemblies and grippable means operatively connected to the other of said upper and lower spindle assemblies, said gripping means being operable to engage said grippable means for drawing said upper spindle toward said lower spindle assembly and said lower spindle assembly toward said upper spindle to clamp a blank to be split between said upper spindle and said lower spindle assembly, a frame for independently supporting said spindle assemblies thereon, a splitting tool supported by said frame and movable toward and away from a blank supported by said spindle assembly to engage with a peripheral edge of the blank to effect splitting thereof, and bearing means disposed between said frame and said spindle assembly for supporting said spindle assembly for rotation relative to said frame, said clamping mechanism being operable to exert a clamping force between said upper spindle and said lower spindle assembly when said gripping means engages said grippable means and which clamping force is isolated from the frame and said bearing means, said splitting tool when engaged with the blank exerting a radial force on said blank, said spindle assembly and said bearing means, and exerting a vertical force on said blank and said upper spindle and said lower spindle assembly between said gripping means and said grippable means which vertical force is counterbalanced between said upper spindle and said lower spindle assembly and isolated from said bearing means.

8. An apparatus for manufacturing split pulleys as defined in claim 7 wherein said bearing means is operable to support the weight of said spindle assembly and further being operable to receive a radial load thereon as a result of the radial forces applied to a clamped workpiece upon engagement of the splitting tool therewith, said clamping mechanism being solely supported by said spindle assembly to isolate said bearing means from the clamping forces established by said clamping mechanism on a clamped blank and said spindle assembly.

9. An apparatus for manufacturing split pulleys comprising a two piece work holder for rotatably supporting a blank to be split, said two pieces of said work holder being relatively movable toward and away from each other to clamp and support a blank therebetween, a splitting tool supported for relative movement toward and away from a blank supported in said work piece holder for engaging with the peripheral edge of the blank to effect splitting thereof, a spindle assembly operatively associated with said work holder for supporting said work holder for rotation, said spindle assembly including a clamping mechanism for drawing one of said pieces of said work holder toward the other of said pieces of said work holder and drawing the other of said pieces of said work holder toward said one piece of said work holder to clamp a blank to be split in said work holder while enabling the clamping forces established in said one of said pieces of said work holder to be counteracted and balanced by the clamping forces established in the other of said pieces of said work holder, a main frame, and bearing means for supporting said spindle assembly for rotation in said main frame, said bearing means supporting the weight of said spindle assembly and being isolated from the clamping forces established on a blank by said clamping mechanism, said spindle assembly including an upper spindle and a lower spindle assembly, said upper spindle supporting one piece of said work holder and said lower spindle assembly supporting the other piece of said work holder, said clamping mechanism being operable to draw said upper spindle toward said lower spindle assembly, said lower spindle assembly including said clamping mechanism disposed therein, said clamping meahanism being disposed concentric to the longitudinal axis of said lower spindle assembly, said clamping mechanism including a screw mechanism operatively associated with said lower spindle for drawing said upper spindle toward said lower spindle assembly upon energization of said clamping mechanism, said upper spindle including locating means attached to said upper spindle and movable relative thereto for centering blanks to be split in said work holder, said locating means including a grippable portion to be gripped by said clamping mechanism and pulled toward said lower spindle assembly upon rotation of said screw mechanism to draw said upper spindle toward said lower spindle assembly.

10. An apparatus for manufacturing split pulleys as defined in claim 9 further including guide surface means for engaging with said finger means and directing said finger means into positive engagement with said locating means upon movement of said finger means in a direction parallel to the axis of rotation of said spindle assembly.

11. An apparatus for manufacturing split pulleys as defined in claim 9 wherein said lower spindle assembly includes a threaded portion which engages with said screw mechanism, said threaded portion being movable in a vertical direction in response to rotation relative thereto of said screw mechanism, said lower spindle assembly further including finger means operatively connected to said threaded portion for movement therewith in a vertical direction, said finger means being engagable with said grippable portion of said locating mechanism to effect movement of said locating mechanism and upper spindle in a vertical direction toward said lower spindle assembly.

12. An apparatus for manufacturing split pulleys comprising a spindle assembly including an upper spindle, a lower spindle assembly, means for rotatably supporting a blank to be split between said upper spindle and said lower spindle assembly, a clamping mechanism for drawing said upper spindle toward said lower spindle assembly and said lower spindle assembly toward said upper spindle to clamp a blank to be split between said upper spindle and said lower spindle assembly, a frame for independently supporting said spindle assembly thereon, a splitting tool supported by said frame and movable toward and away from a blank supported by said spindle assembly to engage with the peripheral edge of the blank to effect splitting thereof, and bearing means disposed between said frame and said spindle assembly for supporting said spindle assembly for rotation relative to said frame, said clamping mechanism being operable to exert a clamping force between said upper spindle and said lower spindle assembly which is isolated from the frame and said bearing means, said clamping mechanism including a screw mechanism for establishing a clamping force between said upper spindle and said lower spindle assembly, said screw mechanism including a first threaded member fixed against axial movement relative to said spindle assembly and a second threaded member engagable with said first threaded member and movable parallel to the axis of rotation of said spindle assembly upon rotation of said first threaded member relative thereto, said movement of said second threaded member establishing said clamping force between said upper spindle and said lower spindle assembly, and locating means associated with said upper spindle for centering blanks to be clamped and split, said clamping mechanism further includes finger members operatively connected to said second threaded member for movement therewith in a direction parallel to the axis of rotation of said spindle assembly, said finger members being adapted to engage with said locating means and moved relative to said lower spindle assembly to effect relative movement of said upper spindle and said lower spindle assembly and clamping of a blank therebetween.

13. An apparatus for manufacturing split pulleys comprising a two-piece work holder for rotatably supporting a blank to be split, said two pieces of said work holder being relatively movable toward and away from each other to clamp and support blank therebetween, a splitting tool supported for relative movement toward and away from a blank supported in said work piece holder for engaging with the peripheral edge of the blank to effect splitting thereof, a spindle assembly operatively associated with said work holder for supporting said work holder for rotation, said spindle assembly including a clamping mechanism, said clamping mechanism including gripping means operatively connected to one of said pieces of said work holder and grippable means operatively connected with the other piece of said work holder, said gripper means being operable to engage said grippable means for drawing said one piece of said work holder toward said other of said pieces of said work holder and drawing said other of said pieces of said work holder toward said one piece of said work holder to clamp a blank to be split in said work holder while enabling the clamping forces established in said one of said pieces of said work holder to be counteracted and balanced by the clamping forces established in said other of said pieces of said work holder, a main frame and bearing means for supporting said spindle assembly for rotation in said main frame, said bearing means supporting the weight of said spindle assembly and being isolated from the clamping forces established on a blank by said clamping mechanism, said spindle assembly including an upper spindle and a lower spindle assembly, said upper spindle supporting one piece of said work holder and said lower spindle assembly supporting the other piece of said work holder, said clamping mechanism being operable to draw said upper spindle toward said lower spindle assembly, said lower spindle assembly including said clamping mechanism disposed therein and said gripping means is associated therewith, said grippable means being associated with said upper spindle assembly, said clamping mechanism being disposed concentric to the longitudinal axis of said lower spindle assembly, said clamping mechanism including a screw mechanism operatively associated with said lower spindle for enabling said gripper means to engage with said grippable means to draw said upper spindle toward said lower spindle assembly upon energization of said clamping mechanism.

14. An apparatus for manufacturing split pulleys as defined in claim 13 wherein said screw mechanism is operable to rotate relative to said lower spindle assembly to clamp a blank in said work holder and said screw mechanism is operable to rotate synchronously with said lower spindle assembly to rotate the clamped blank.

15. An apparatus for manufacturing split pulleys as defined in claim 13 wherein said screw mechanism is fixed against vertical movement relative to said lower spindle assembly and said lower spindle assembly includes a threaded portion which engages with said screw mechanism, said threaded portion being movable in a vertical direction in response to rotation relative thereto of said screw mechanism; said vertical movement of said threaded portion enabling said screw mechanism to draw said upper spindle toward said lower spindle assembly and enabling said lower spindle assembly to be drawn toward said upper spindle upon rotation of said screw mechanism relative to said threaded portion.

16. An apparatus for manufacturing split pulleys comprising a spindle assembly including an upper spindle, a lower spindle assembly, means for rotatably supporting a blank to be split between said upper spindle and said lower spindle assembly, and a clamping mechanism, said clamping mechanism including gripping means operatively connected to one of said upper and lower spindle assemblies, and grippable means operatively connected to the other of said upper and lower spindle assemblies, said gripping means being operable to engage said grippable means for drawing said upper spindle toward said lower spindle assembly and said lower spindle assembly toward said upper spindle to clamp a blank to be split between said upper spindle and said lower spindle assembly, a frame for independently supporting said spindle assemblies thereon, a splitting tool spported by said frame and movable toward and away from a blank supported by said spindle assembly to engage with the peripheral edge of the blank to effect splitting thereof, and bearing means disposed between said frame and said spindle assembly for supporting said spindle assembly for rotation relative to said frame, said clamping mechanism being operable to exert a clamping force between said upper spindle and said lower spindle assembly when said gripping means engages said grippable means and which clamping force is isolated from the frame and said bearing means, said clamping mechanism including a screw mechanism for establishing a clamping force between said upper spindle and said lower spindle assembly by effecting engagement of said gripping means with said grippable means, said screw mechanism including a first threaded member fixed against axial movement relative to said spindle assembly and a second threaded member engageable with said first threaded member and movable parallel to the axis of rotation of said spindle assembly upon rotation of said first threaded member relative thereto, said movement of said second threaded member establishing said clamping force between said upper spindle and said lower spindle assembly.

17. An apparatus for manufacturing split pulleys as defined in claim 16 further including selectively actuatable power means for establishing the clamping forces to clamp a blank in said spindle assembly and for effecting rotation of the spindle assembly and the clamped blank relative to said splitting tool, said power means being operable to effect relative rotation of said first and second threaded members to effect clamping of a blank in said spindle assembly and being operable to effect synchronous rotation of said first and second threaded members and said spindle assembly to effect rotation of a clamped blank supported by said spindle assembly.

* * * * *

UNITED STATES PATENT AND TRADEMARK OFFICE

CERTIFICATE OF CORRECTION

PATENT NO. : 4,078,410

DATED : 3/14/78

INVENTOR(S) : Anthony Lemmo

It is certified that error appears in the above-identified patent and that said Letters Patent are hereby corrected as shown below:

| | |
|---|---|
| Col. 4, line 3: | "rotated" should read "rotate" |
| Col. 7, line 51: | "slit" should read "split" |
| Col. 10, line 24: | "affected" should read "effected" |
| Col. 16, line 20: | "spported" should read "supported. |

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*